United States Patent [19]

Crothers

[11] 4,338,756

[45] Jul. 13, 1982

[54] PANEL AND INSULATION SYSTEM

[75] Inventor: Charles J. Crothers, Cherry Hill, N.J.

[73] Assignee: Thermacon Industries, Inc., Moorestown, N.J.

[21] Appl. No.: 158,666

[22] Filed: Jun. 12, 1980

[51] Int. Cl.[3] ..... E04G 11/04; E04B 2/18; E04B 1/68

[52] U.S. Cl. ..... 52/539; 52/248; 52/105; 52/573; 220/452

[58] Field of Search ..... 52/276, 248, 518, 539, 52/573; 220/9 F, 435, 437, 452

[56] References Cited

U.S. PATENT DOCUMENTS

| | | | |
|---|---|---|---|
| Re. 27,330 | 4/1972 | Marcmann | 220/9 F |
| 2,049,278 | 7/1936 | Toussaint et al. | 52/276 |
| 2,323,297 | 7/1943 | Collins | 52/248 |
| 3,881,292 | 5/1975 | Porter | 52/276 |
| 4,163,347 | 8/1979 | Marcmann | 52/105 |
| 4,192,116 | 3/1980 | Kelly | 52/518 |
| 4,225,055 | 9/1980 | Hills et al. | 220/452 |

*Primary Examiner*—James L. Ridgill

*Attorney, Agent, or Firm*—Seidel, Gonda, Goldhammer & Panitch

[57] ABSTRACT

Preformed panels having a layer of insulation secured to the rear surface of a facing layer are retained in position against a wall by horizontally disposed banding having resiliently coupled ends. A vertical member along one side edge portion of a panel has a spring portion terminating in a flange angled outwardly away from the facing sheet so that a side edge portion of the next adjacent facing sheet may be inserted therebetween and clamped against the facing sheet of the first panel to thereby interlock adjacent horizontally disposed panels.

9 Claims, 9 Drawing Figures

FIG. 1
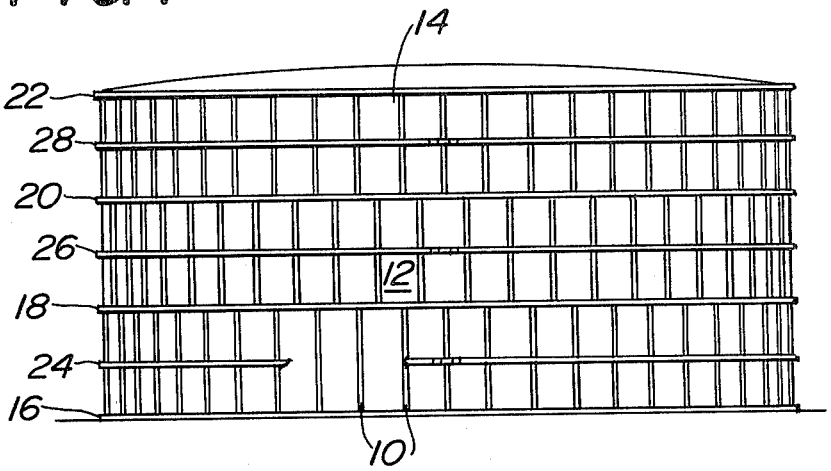
FIG. 3
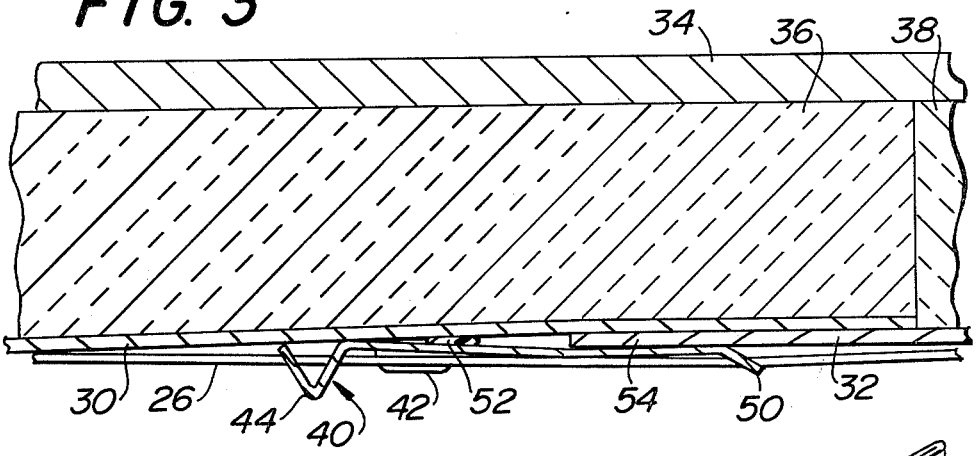
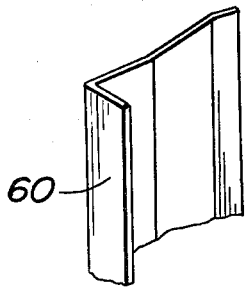
FIG. 4
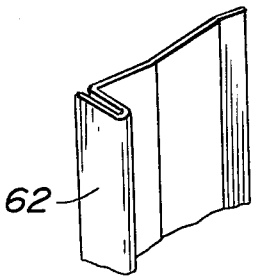
FIG. 5
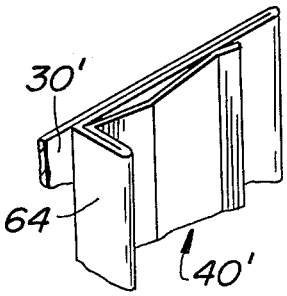
FIG. 6

FIG. 7
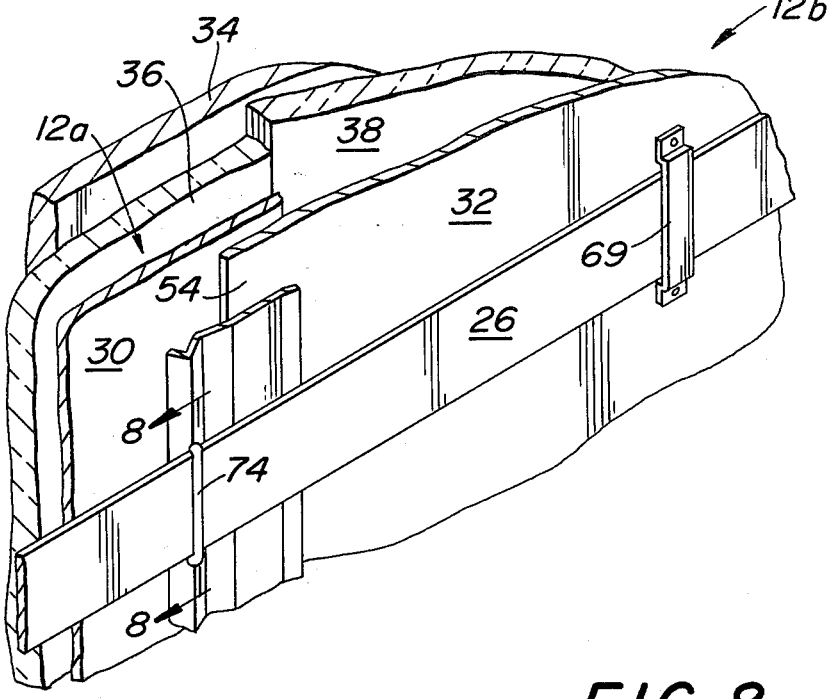
FIG. 8
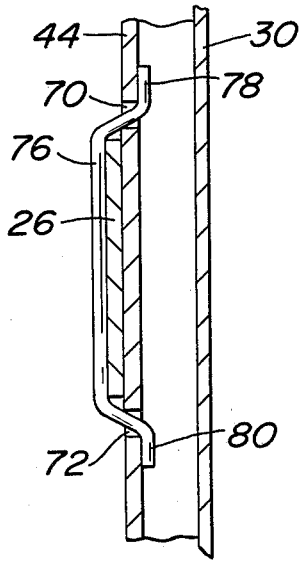
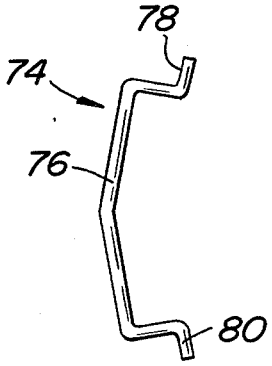
FIG. 9

PANEL AND INSULATION SYSTEM

BACKGROUND OF THE INVENTION

Panels and insulation systems of the general type involved herein are known. For example, see U.S. Pat. No. Re. 27,330 and U.S. Pat. No. 4,163,347. The panels are utilized to thermally insulate tanks and/or pipes but may be utilized for other structures. The panels disclosed in said patents are generally 4'×8' with the longer side edges being horizontally disposed. In said patents, and commercial embodiments thereof, banding overlies the joints between panels and constitutes the means for keeping the vertical seal between adjacent panels weather-tight. It is essential that the panels be permitted to expand and contract to the circumferential direction with temperature changes of the tank or other structure which is insulated.

The present invention is directed to a solution of the problem of how to make the joint between adjacent panels in systems of the type disclosed in said prior art patents more efficient while at the same time decreasing the cost of the system.

SUMMARY OF THE INVENTION

The present invention is directed to a panel and an insulation system of interconnected panels. Each panel is rectangular so as to have a top edge and a bottom edge interconnected by parallel side edges. Each panel has insulation secured to a rear surface of a facing layer in a manner so that the insulation is spaced from the bottom edge and one of the side edges of the facing layer. That structure enables the bottom edge portion and said one side edge portion to overlap the next adjacent panel in an insulation system.

A vertical member is secured to the facing layer of the panel in a manner so as to be parallel to but spaced from the other side edge of the panel. A central portion of the vertical member is notched, slotted, punched or otherwise arranged to receive a banding. The vertical manner has a spring portion terminating in a flange angled outwardly away from the facing sheet to facilitate introduction of a side edge portion of a facing sheet therebetween. The spring portion overlies and clamps the last-mentioned side edge portion of the next adjacent facing layer against its associated facing layer.

It is an object of the present invention to provide a novel insulating panel and insulating system.

It is an object of the present invention to provide an insulating panel and system which is more efficient in terms of sealing against the weather while at the same time decreasing the cost, eliminating secondary painting, and eliminating excess banding.

It is another object of the present invention to provide an insulation system for tanks which does not rely on band pressure to keep the vertical seal between adjacent panels weather-tight while at the same time permitting the panels to expand and contract in a circumferential direction.

It is another object to provide an insulation panel that can be installed on a side wall or on a roof.

Other objects will appear hereinafter.

For the purpose of illustrating the invention, there is shown in the drawings a form which is presently preferred; it being understood, however, that this invention is not limited to the precise arrangements and instrumentalities shown.

FIG. 1 is an elevation view of a tank structure insulated in accordance with the present invention.

FIG. 3 is a sectional view taken along the line 3—3 in FIG. 2 but on an enlarged scale.

FIGS. 4–6 show alternative sectional configurations for the vertical member.

FIG. 7 is a view similar to FIG. 2 but showing another embodiment.

FIG. 8 is a sectional view taken along the line 8—8 in FIG. 7.

FIG. 9 is a side elevation view of a retainer before installation.

DETAILED DESCRIPTION

Figure 2:
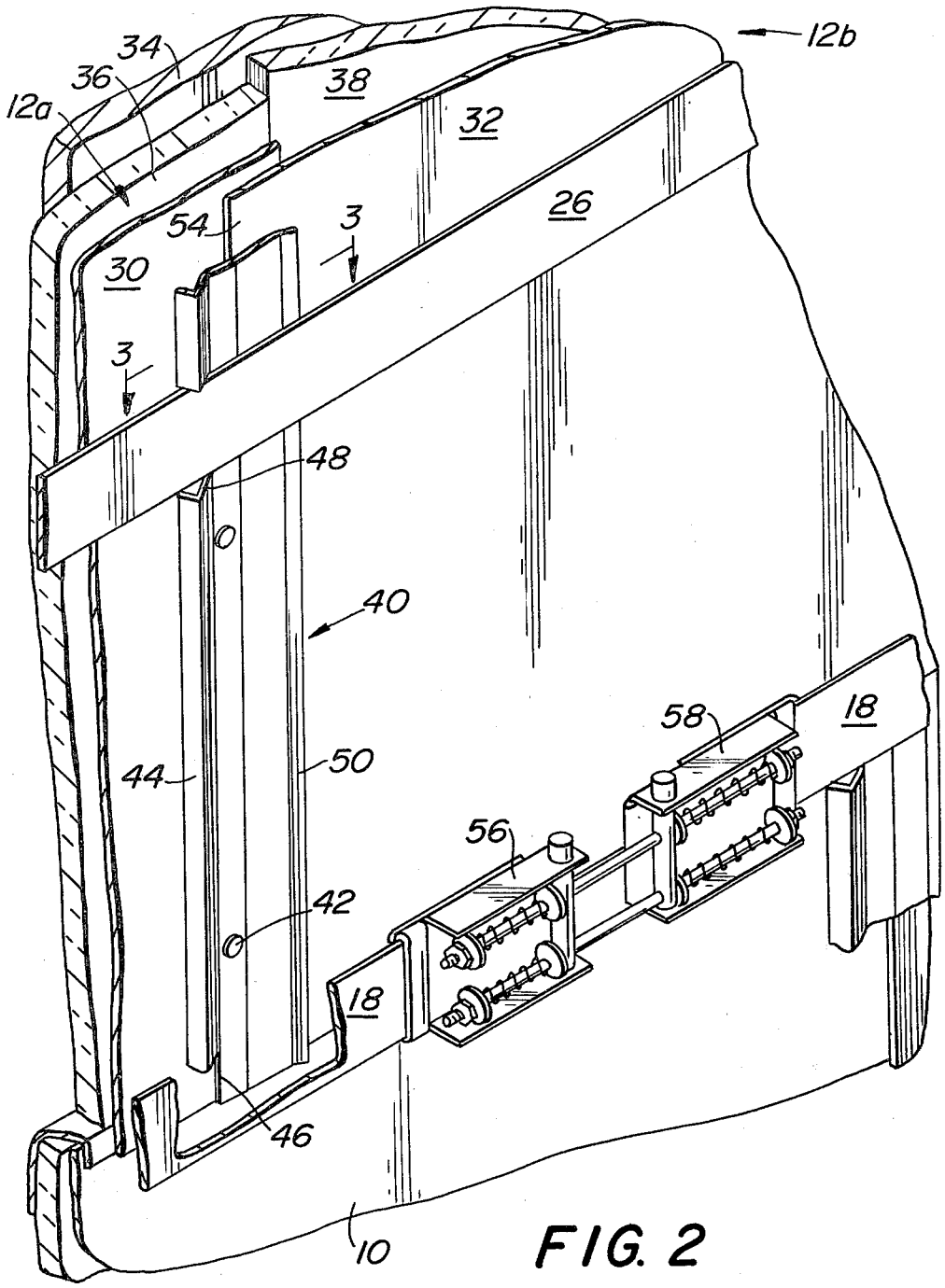
FIG. 2 is an enlarged partial perspective view of the joint between two adjacent panels and a panel therebelow.

Referring to the drawings in detail, wherein like numerals indicate like elements, there is shown an insulating system in accordance with the present invention installed around the outer periphery of an internally heated tank for storing petroleum products or the like. As illustrated in FIG. 1, the tank is insulated by a first row of panels 10, a second row of panels 12, and a third row of panels 14. While only three rows of panels are illustrated in FIG. 1, a greater number of rows of panels will be utilized depending upon the height of the tank structure.

Horizontally disposed banding 16 overlies the lower edge portion of the panels 10. Horizontally disposed banding 18 overlies the joint between the upper end of panels 10 and the lower end of panels 12. Horizontal banding 20 overlies the joint between the upper end of panels 12 and the lower end of panels 14. Horizontal banding 22 overlies the upper end of panels 14. Each of the panels is preferably also retained in position by a middle banding. The horizontally disposed middle banding for panels 10 is designated 24 with comparable banding 26 and 28 being provided for the panels 12, 14 respectively. Each of the banding 16–28 is identical and may be of the type disclosed in either one of the above-mentioned patents. The banding are preferably one or more strips having adjacent ends resiliently coupled together by clamps which are selectively adjustable.

In the above-mentioned patents and the commercial installations corresponding thereto, the panels are 4'×8' with the 8' dimension being horizontally disposed. The panels 10, 12 and 14 of the present invention are preferably 4'×6' with the 6' dimension being vertically disposed. The panels of the present invention are comprised of a facing layer such as sheet having a thickness of about 0.030 inches with a layer of foam secured to a rear surface thereof. The preferred material for the facing layer is aluminum type 3105H18. The foam insulation is preferably isocyanurate foam having a thickness of 1 to 2 inches. The foam is smaller than the size of the facing sheet by a distance of about 1 to 2 inches along the bottom edge portion of the facing sheet and by a similar dimension along one vertical side edge of the facing sheet.

Referring to FIG. 2, there is illustrated the intersection between two of the panels designated **12*a* and 12*b* with the joint between their vertical side edges being staggered with respect to the panel 10 therebelow. The facing sheet on panel 12*a* is designated 30 while the corresponding facing sheet of panel 12*b* is designated 32. The wall of the tank structure is designated 34. The insulation secured to the rear surface of facing sheet 30** is designated 36 and the insulation secured to the rear surface of facing sheet 34 is designated 38.

A vertical member 40, which is preferably made from the same material as the facing sheets 30, 32, is fixedly secured to the facing sheet 30 adjacent to but spaced from one side edge of the facing sheet. The securement of member 40 to sheet 30 may be obtained in any convenient manner such as by spot welds or rivets 42. The member 40 has an upset or roll formed portion 44 which is V-shaped as shown in FIGS. 2 and 3 so as to increase the rigidity of member 40. A suitable width for member 40 is 2-½ to 3 inches. The portion 44 is notched, slotted, punched or otherwise constructed so as to remove metal from each end of portion 44 for accommodating one of the banding. As shown in FIG. 2, the lower end of member 44 is provided with a notch 46 for receiving the banding 18. The upper end of portion 44 on member 40 is constructed in like manner for receiving banding 20. In addition, portion 44 may be provided with a notch 48 intermediate its ends for receiving the middle banding 26.

As will be apparent from FIGS. 2 and 3, portion 44 is disposed to one side of the rivets 42. To the other side of the rivets 42, the member 40 is in the form of a leaf spring with the middle portion thereof arched. The terminal right edge portion of member 40 in FIGS. 2 and 3 includes a flange 50 which is angled away from the facing layer 30 at an acute angle of approximately 20° to 40°. The terminal edge of flange 50 is spaced from the adjacent edge of panel 30 by a distance of about ½ to ¾ of an inch. A seal 52 is provided between the member 40 and the facing layer 40 along the entire length thereof in the area where the rivets 42 are located. The seal 52 may be any one of a wide variety of seals such as caulking, rubber, plastic, etc.

When panels 12*a* and 12*b* are assembled, the free edge portion 54 on layer 32 may be slipped into the space between the vertical member 40 and the facing layer 30. Flange 50 facilitates the ease with which this may be accomplished. It will be noted from FIGS. 2 and 3 that the flange 50 is spaced from but adjacent to the right-hand edge of facing layer 30. Portion 54 on panel 12*b* is positioned so as to overlie the righthand edge of facing layer 30 and then one of the panels is moved horizontally until portion 54 is embraced by the member 40 and clamped against layer 30 on panel 12*a*. A coupling of this nature does not interfere with the ability of the panels to expand and contract with the tank wall 34 while at the same time causes one panel to capture the next adjacent panel in the same row so that they cannot separate in a radial direction with respect to the wall 34.

Such capturing of one panel by the next adjacent panel enables the two panels to be self-sustaining whereby they need not be held in place by an erector pending application of the banding. This is an advantage whereby fewer erectors are needed to install the system. At the same time, the vertical joint between two adjacent panels in the same row is weather-tight. Due to the fact that member 40 is made from the same material as facing layers 30 and 32, all of which are pre-painted, no secondary painting is required. Panels are held in place without relying solely on the pressure of the banding.

Referring to FIG. 2, each of the facing layers 30, 32 has a bottom edge portion which overlaps the upper edge portion of the panel 10. This relationship is per se known from the above-mentioned patents. In FIG. 2, adjacent ends of banding 18 are resiliently coupled together by way of adjustable clamps 56 and 58 which are conventional.

In FIGS. 4–6, there is illustrated alternative cross-sections for the member 40. The various embodiments of the member 40 in FIGS. 4–6 differ from one another only in the cross-section of portion 44 which could be a straight flange 60 as shown in FIG. 4, could be bent back along itself as shown at 62 in FIG. 5, or as shown at 64 in FIG. 6. In FIG. 6, the member 40′ is integral in one piece with the face sheet designated 30′. In each embodiment of the present invention, the vertical member reinforces its associated panel while at the same time acts as a means for embracing and retaining the facing layer of the next adjacent panel.

As shown in FIG. 7, the middle banding 26 may be coupled to layer 32 only by passing through a loop defined by U-shaped retainer 69 which is spot welded or riveted to layer 32. Retainers 69 maybe pop riveted at the installation as the sole means for retaining middle banding and/or joint banding. Alternatively, the banding 26 may be coupled only to portion 44 by a metal U-shaped retainer 74. The retainer 74 in the form prior to installation may be configured as shown in FIG. 9. The portion 44 has a pair of openings 70, 72 spaced apart wider than banding 26. Leg 78 is introduced through opening 70 and leg 80 is introduced through opening 72. Thereafter, pressure is applied against the bight 76 to flatten the bight 76 against banding 26 and spread legs 78, 80 apart as shown in FIG. 8. Opening 70, 72 may be preformed or applied in the field so that middle banding 26 may be applied where needed at the time of initial installation or subsequent thereto. If desired, each of the retainers 69 and 74 may be used.

Commercial embodiments of prior art systems such as those disclosed in the above-mentioned patents utilize panels which are 4′×8′. Conventional 4′×8′ panels as installed commercially have a middle banding at a preset location. The present invention allows middle banding to be applied every foot, every two feet or every three feet, depending on structural requirements, wind effect on the tank, the size of the tank, etc. By using 4′×6′ panels, a greater number of panels may be stacked on the erection boom whereby installation of panels takes less time.

While member 40 preferably extends for substantially the entire height of the panel, member 40 may be made in the form of a plurality of aligned pieces with the space between the panels performing the function of notch 48. The panels of the present invention may be retained in position by studs connected to the juxtaposed wall or roof of a tank and extending through the panels thereby eliminating the bands. Thus, banding is less practical than other means for retaining insulation panels on a roof of a tank or other structure.

The system of the present invention relates costs while at the same time provides for a more efficient weather seal and facilitates erection with fewer pesonnel whereby the system is unique and advances the state of the art. While the panels illustrated are rectangles, other quadrangular shapes may be used.

The present invention may be embodied in other specific forms without departing from the spirit or essential attributes thereof and, accordingly, reference should be made to the appended claims, rather than to the foregoing specification, as indicating the scope of the invention.

I claim:

1. A panel for use in an insulation system, said panel having a top edge and a bottom edge interconnected by first and second side edges, insulation secured to a rear surface of a facing layer of the panel in a manner so that the insulation is spaced from the bottom edge and from said first edge, means including a reinforcement member secured to said facing layer adjacent to but spaced from the second side edge of the panel for clamping an edge on a similarly constructed panel, said reinforcement member having a portion terminating at an edge in a flange angled outwardly from the facing layer, said portion overlying said facing layer and being arranged therewith to clamp a portion of a similarly constructed panel inserted between.

2. A panel in accordance with claim 1 wherein said flange is spaced from said second side edge by a distance of about ½ to ¾ of an inch.

3. A panel in accordance with claim 1 wherein said side edges are about 50% longer than said top and bottom edges.

4. A panel in accordance with claim 1 wherein an edge portion of the member remote from said flange is reinforced and secured to said facing sheet, and a seal between said facing layer and said member.

5. A system comprising a plurality of panels in accordance with claim 1, said panels being disposed side-by-side with their side edges being longer than their top and bottom edges, the side edges being vertically disposed, and horizontal banding extending across the middle of said panels in overlying relationship, the membes on said panels being adapted intermediate their ends so as to accommodate said middle banding.

6. A panel in accordance with claim 1 including a generally U-shaped retainer fastened to an outer surface of the panel and adapted to overlie said middle banding.

7. A panel in accordance with claim 6 wherein said retainer is connected to said reinforcement member.

8. A panel for use in an insulation system and adapted to be circumferentially offset from panels in an adjacent row, said panel having a top edge edge and a bottom edge interconnected by parallel side edges, insulation secured to a rear surface of a facing layer of the panel in a manner so that the insulation is spaced from the bottom edge and from one of said side edges, a vertical reinforcement member secured to the panel, characterized by the vertical member being secured to the outer surface of the facing layer parallel to but spaced from the other side edge of the panel, said vertical member having a portion terminating at a vertical edge in a flange angled outwardly from the facing layer, said flange being spaced from said other side edge by a distance of about ½ to ¾ of an inch, said portion being arranged for overlying and clamping relationship with the facing layer and adapted to receive therebetween a first edge on a similarly constructed panel, and an edge portion of the vertical member remote from said flange being reinforced and secured to said facing layer.

9. A panel in accordance with claim 8 wherein said side edges are about 50% longer than said top and bottom edges, and said panel being arcuate across the side edges.

* * * * *